US008235784B2

(12) United States Patent
Christensen

(10) Patent No.: US 8,235,784 B2
(45) Date of Patent: Aug. 7, 2012

(54) METHOD FOR INITIATING A GROUP PLAY FEATURE ON A PLURALITY OF CASINO GAMES

(75) Inventor: Erik Christensen, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 1137 days.

(21) Appl. No.: 12/108,468

(22) Filed: Apr. 23, 2008

(65) Prior Publication Data

US 2009/0270157 A1 Oct. 29, 2009

(51) Int. Cl.
*A63F 9/24* (2006.01)

(52) U.S. Cl. ..... 463/16; 463/20; 463/22; 463/30

(58) Field of Classification Search ..... 463/16
See application file for complete search history.

(56) References Cited

U.S. PATENT DOCUMENTS

| | | | | |
|---|---|---|---|---|
| 7,758,423 | B2 | 7/2010 | Foster et al. | |
| 2006/0073868 | A1 * | 4/2006 | Nordman | 463/16 |
| 2008/0111408 | A1 * | 5/2008 | Duran et al. | 297/217.4 |

* cited by examiner

*Primary Examiner* — David L Lewis
*Assistant Examiner* — Werner Garner
(74) *Attorney, Agent, or Firm* — Steptoe & Johnson LLP

(57) ABSTRACT

The present invention is directed to a method for presenting a game having a bonus feature. The method includes initiating a game on at least one of a plurality of gaming machines associated with one another and arranged in a circular bank. The gaming machines are monitored to determine whether a triggering event has occurred on any of the plurality of gaming machines. A bonus feature is initiated on all of the plurality of gaming machines in response to the triggering event. The bonus feature play includes activating indicators associated with each gaming machine located around the circular bank, in a sequential order, for a specific amount of time. At the end of the sequence only one gaming machine indicator remains activated, designating a winner of the bonus feature. The winner is awarded a bonus.

22 Claims, 5 Drawing Sheets

METHOD FOR INITIATING A GROUP PLAY FEATURE ON A PLURALITY OF CASINO GAMES

CROSS-REFERENCE TO RELATED APPLICATIONS

This application is related to co-pending U.S. patent application Ser. No. 12/108,460, filed Apr. 23, 2008.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Many games of chance and gaming machines have been developed that have various features designed to capture and maintain player interest. Traditionally, games garner player interest by providing the player with the opportunity to win cash awards based upon a player's wager. For example, games may include one or more bonus games or the opportunity to win progressive jackpots in order to maintain player interest.

Additionally, over the years, games have grown in both sophistication and in the types of gaming features used to maintain a player's interest. For example, the mechanical reels of traditional gaming machines have been replaced with video depictions of spinning reels. These video gaming machines may provide a richer gaming experience for players by including graphics or animation as part of the game. However, there is a continuing need for games that provide player excitement and diversity of game play without creating overly complex games that unacceptably diminish player comfort.

SUMMARY

Briefly, and in general terms, various embodiments are directed to a method for presenting a game with a bonus feature, the method including initiating a game on at least one of a plurality of gaming machines associated with one another and arranged in a circular bank or any other shape, pattern, or random pattern on the casino floor. A gaming system determines whether a triggering event has occurred on any of the plurality of gaming machines. If a triggering event occurs, a bonus feature is initiated on all of the plurality of gaming machines. In one embodiment, an announcement is made when the bonus feature is triggered. The announcement may be visual, tactile, audible, or any combination thereof, to generate excitement that the bonus feature is about to start. The method of presenting the game with a bonus feature also includes illuminating indicators or lights associated with each gaming machine in a sequential order around the circular bank for an amount of time. In this embodiment, the lights associated with each gaming machine light up one after the other to highlight one gaming machine at a time. A frequency of illuminating the indicators or lights associated with each gaming machine in a sequential order around the bank of associated gaming machines may be increased or decreased to enhance the excitement of the bonus feature. The progression along the sequential order of illuminating the lights comes to a stop, leaving only one indicator illuminated to designate a winner of the bonus feature. A bonus is awarded to the winner of the bonus feature, and the bonus may be monetary or any other prize or items, as decided by the administrator of the bonus feature system.

In another embodiment, the excitement of playing the gaming machines can be enhanced by providing additional means of excitement at each player locations. For example, by vibrating the player chair by placing a vibration device within the seat or back of a chair as light passes by the player. Still further, other tactile providers can be used in the chair or at the gaming machine to increase the excitement when the bonus feature becomes activated.

In another embodiment, the trigger event to start the bonus feature is a winning outcome, a randomly selected game outcome, a specialized bonus symbol, a predetermined number of maximum wagers, a predetermined number of paylines played, a player card level, time of play, frequency of play, a mystery pay, or a combination thereof. The trigger may also be based upon a player's gaming activity, level within a club, based upon chance, or a skill based outcome.

In one embodiment, the method of presenting a game including a bonus feature may determine or track which of the plurality of gaming machines are being activated by a player. Therefore, when awarding a bonus to the winner, a gaming machine not being activated or occupied by a player is prevented from being awarded a bonus. The frequency or likelihood of a bonus award can be randomly awarded to a player or the bonus can be weighted so that players with high club rankings, greater play activity, higher wagering activity and the like are more likely to be awarded the bonus. This can be accomplished using the networked system or bonus module to monitor and track the players at each gaming machine to properly weight the prize award.

This method concept can also be used with tournaments, progressives, and system based gaming to award prizes to a player. For example, the system may allow a winner of a system based game prize, and then the gaming machine lights flash in sequential order and stop, with only one set of lights remaining activated on the winning gaming machine.

Other features and advantages will become apparent from the following detailed description, taken in conjunction with the accompanying drawings, which illustrate by way of example, the features of the various embodiments.

DETAILED DESCRIPTION

Generally, various embodiments disclosed herein are directed to a group play feature involving a plurality of gaming machines associated together, wherein a bonus feature is triggered (generally by random) by one of the associated gaming machines and a player at one of the plurality of gaming machines is awarded a bonus. In one embodiment, the plurality of gaming machines are arranged in a circular bank, and each gaming machine has associated with it at least one identifier or indicator. The identifier can be visible, tactile and/or audible, and may include any colored or white lights located in the center of the circular bank, on the seatbacks of the chairs surrounding the gaming machines, and in other locations associated with the gaming machines as well. When the bonus feature is triggered, an announcement may be made to the players, either visually, tactilely, audibly, or any combination thereof. Thereafter, the lights associated with each gaming machine are illuminated sequentially, one at a time, around the circular bank in an increasingly faster fashion. In another embodiment, the frequency of illuminating the lights in a sequential manner is decreased. The winner of the bonus feature is identified when the sequential progression of the indicators ceases so that only one of the gaming machines indicators remains activated. It is perceived by the players that a single light is moving in a circular motion around the bank of gaming machines and then comes to a stop at one gaming machine. The player at the gaming machine with the illuminated light or indicator at the end of the bonus feature is awarded a bonus. In one embodiment the bonus payout is weighted to players betting the maximum amount.

The gaming system disclosed herein effectively employs a popular group play dynamic in an observable and alluring manner, while repurposing existing library games, thereby extending their floor lives. Additionally, the games in the system can be easily swapped in and out for any event, including a promotional event.

Figure 1:
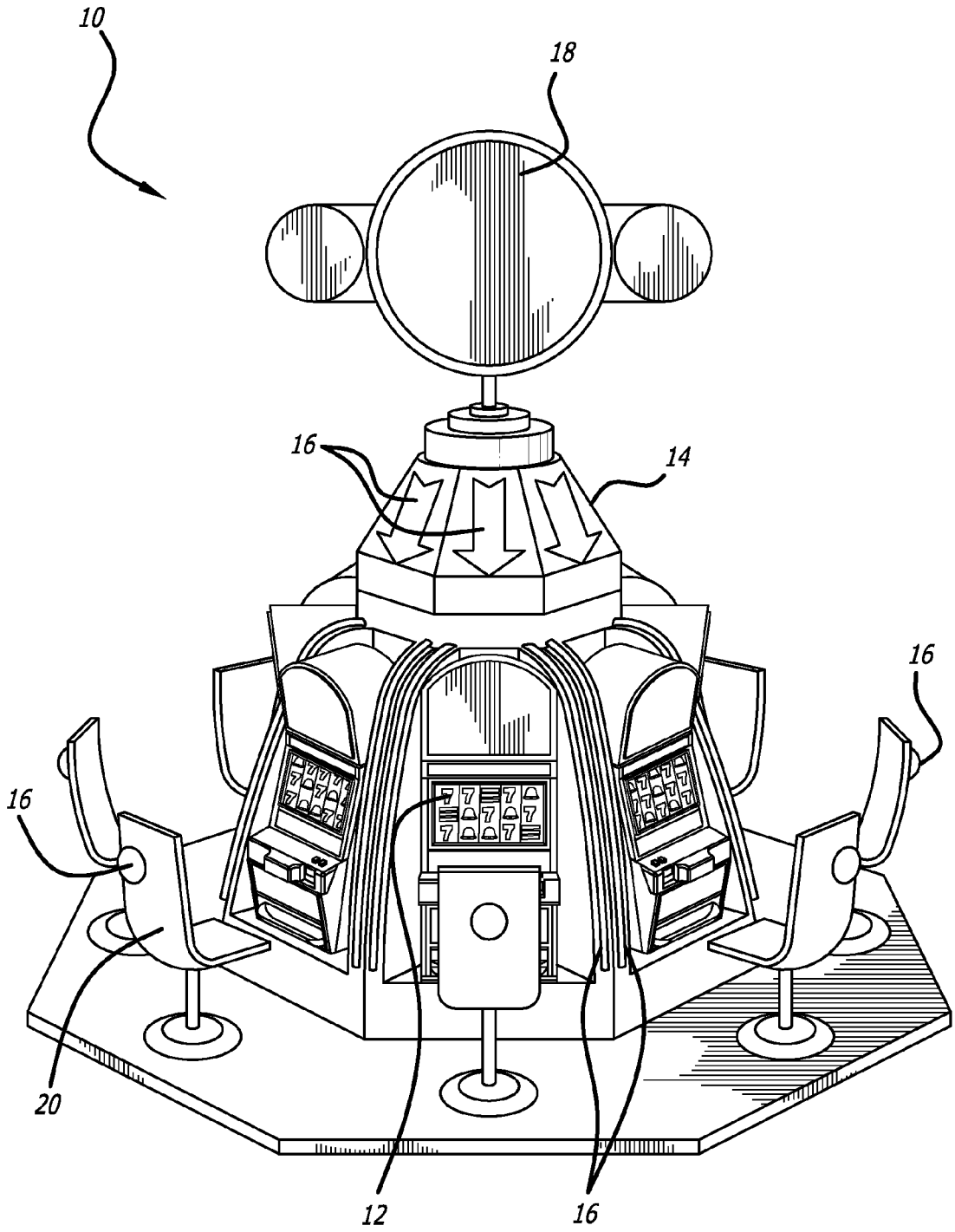
FIG. 1 depicts one embodiment of a circular bank of gaming machines configured for use with a group play feature.

Referring now to the drawings, wherein like reference numerals denote like or corresponding parts throughout the drawings, there are shown various embodiments of a gaming machine system presenting a group play dynamic with a bank of associated gaming machines including a bonus feature. More specifically, as shown in FIG. 1, a circular bank of gaming machines 10 is shown to include eight individual gaming machines 12 that are all associated together. In this embodiment, there are eight linked gaming machines that each appear to be a "wedge" or one-eight of the circular bank. It has been contemplated that other game bank designs, such as square, rectangular, oval, star, or any other shape can be used on the casino floor. Machines situated around the casino floor may also be chosen in no particular pattern. Also, more or less than eight gaming machines may be associated with each other and included in the group play feature.

Still referring to FIG. 1, in one embodiment, a central display unit 14 is disposed above the circular bank of gaming machines 10. The central display unit may include indicators or lights 16, each used to identify one of the plurality of gaming machines 12. There also may be a promotional display 18 disposed above the central display unit to promote the group play feature within the casino. In some embodiments, the indicators 16 can also be located on the seatbacks of chairs 20 disposed around the gaming machines, or between the gaming machines as shown in FIG. 1. In other embodiments, the indicators can be located on the screen of the gaming machine, e.g., a portion of the screen or the entire screen can flash a different color. Any combination of such indicators may also be used.

In one embodiment, a bonus feature module 21 is in communication with the plurality of gaming machines 12 and the plurality of indicators 16. The bonus feature module 21 monitors the plurality of gaming machines for the occurrence of an event in one of the plurality of gaming machines. The event may be any predetermined or random event, such as, but not limited to, exceeding an "$n^{th}$ coin in" threshold, a winning outcome, a randomly selected game outcome, a specialized bonus symbol, a predetermined number of maximum wagers, a predetermined number of paylines played, a player card level, time of play, frequency of play, a mystery pay, or a combination thereof. The trigger may also be based upon a player's gaming activity or level within a club, based upon chance or a skill based outcome. Once the triggering event is detected on at least one of the gaming machines, the bonus feature module 21 will initiate the bonus feature on all associated gaming machines, or on all qualifying gaming machines. Also, the bonus feature module 21 will determine (typically in a random manner) the bonus feature winner and award a bonus to the winning player. The bonus may be any monetary award or a prize.

In one embodiment, the triggering event is random. However, it has been contemplated that the triggering event may be pseudo-random, skill based, or a combination thereof.

The frequency or likelihood of a bonus award can be randomly awarded to a player or the bonus can be weighted so that players with high club rankings, greater play activity, higher wagering activity and the like are more likely to be awarded the bonus. This can be accomplished using the networked system or bonus module to monitor and track the players at each gaming machine to properly weight the prize award.

Figure 2A:
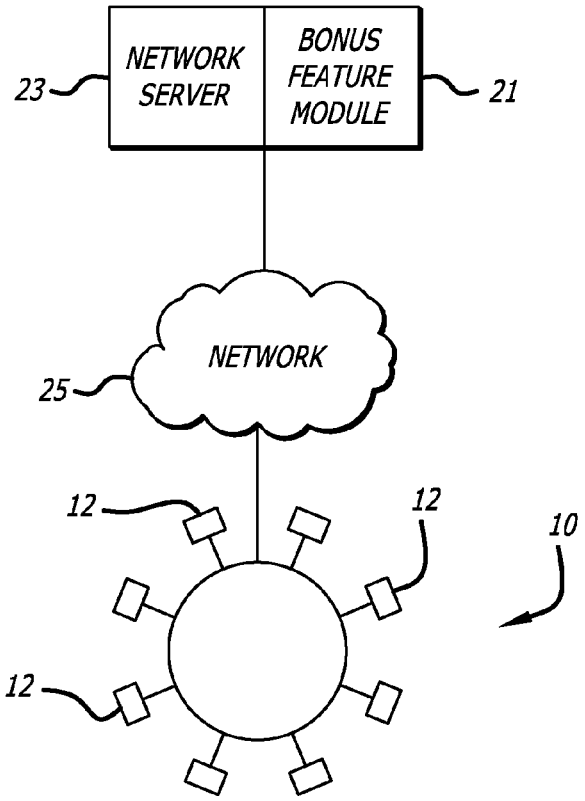
FIG. 2A depicts a diagram of one embodiment of a gaming system wherein a bonus feature module is stored on a network server.
Figure 2B:
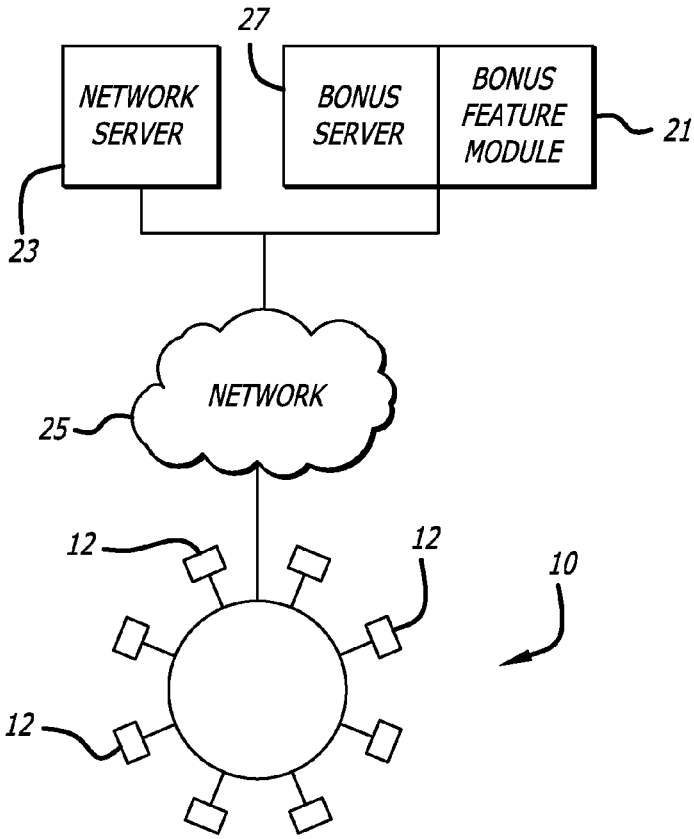
FIG. 2B depicts a diagram of another embodiment of a gaming system wherein a bonus feature module is stored on a bonus server separate from the network server.

The bonus feature module 21 may be stored on any of the plurality of gaming machines 12. The bonus feature module can be a processor assembly including a processor, memory tangibly embodying instructions which comprise an operating system and one or more applications. Operating system and applications are comprised of instructions which, when read and executed by the computer processor causes the function to be performed. In one embodiment shown in FIG. 2A, the bonus feature module 21 may be stored on a network server 23 that is in communication with the plurality of gaming machines 12 through a network 25. In another embodiment shown in FIG. 2B, the bonus feature module 21 may be stored on a bonus server 27, separate from the network server 23, wherein the bonus server is in communication with the plurality of gaming machines 12 through the network 25. It has been contemplated that the bonus server 27 can be located within any one of the gaming machines, in the center of the circular bank of gaming machines, remote from the gaming machines, or on the back end system.

Figure 3:
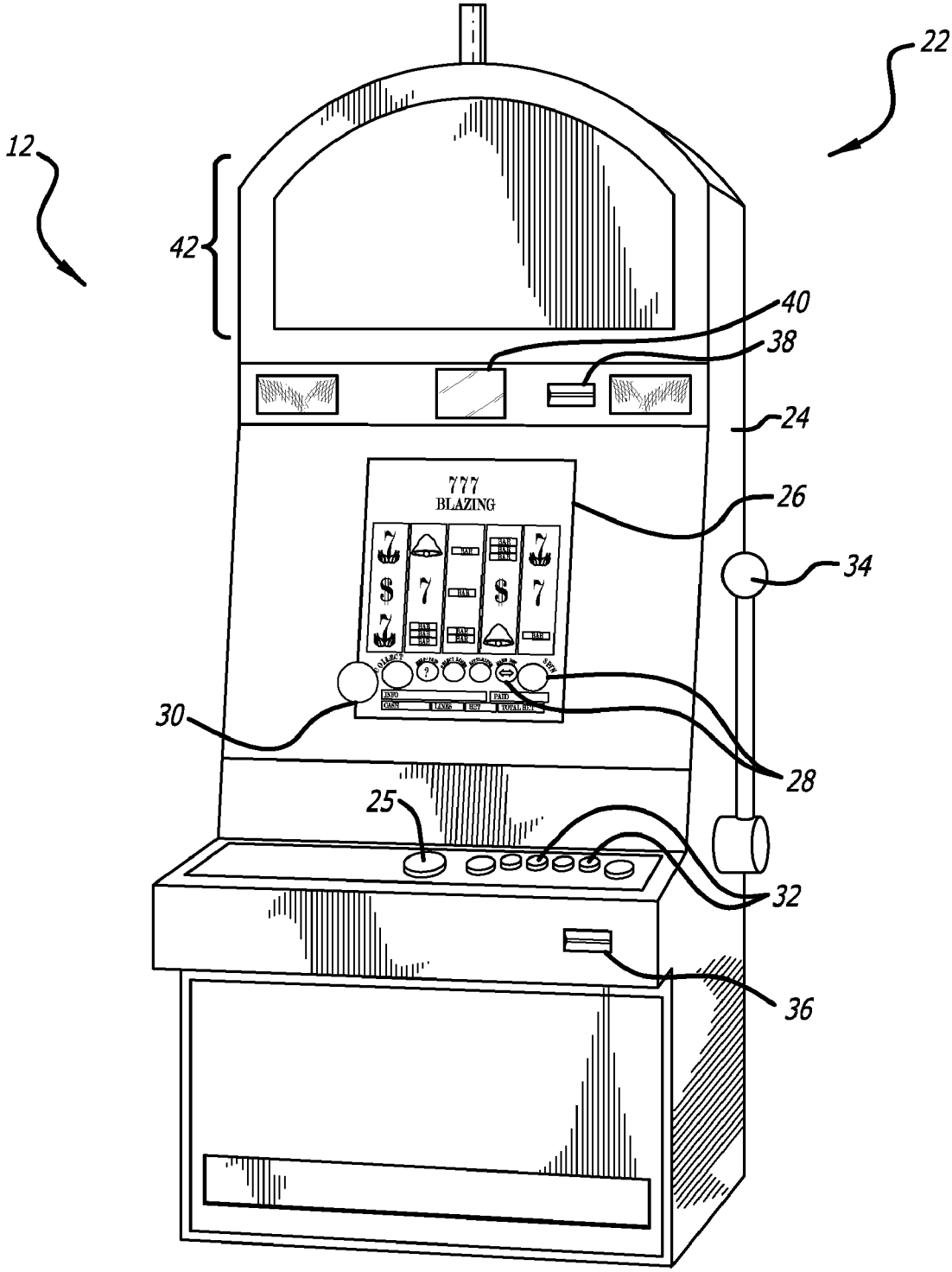
FIG. 3 depicts one embodiment of a gaming machine associated with the bank of gaming machines shown in FIG. 1.

FIG. 3 depicts an embodiment of one of the gaming machines 12 in the circular bank 10, which is a five reel slot game 22. The machine includes a gaming cabinet 24 that houses a display screen 26. Optionally, the display 26 may include a touch screen system (not shown). In other embodiments, the five reel video slot game can be replaced by any game, including mechanical slots, video keno, video poker, video blackjack, video roulette, Class II bingo, games of skill, or games of chance involving some player skill. For the sake of brevity and clarity, the following disclosure and examples of the game is a slot-type game, but those skilled in the art will appreciate that any of the above-referenced games or others may be presented in the gaming machine 12.

The game 22 includes a dedicated set of buttons 28 having functions such as, but not limited to, a collect button (or cash-out), select lines button, bet per line button, max bet button, and a spin button. A max bet button 30 is also disclosed and allows the player to place a maximum wager. In one embodiment, the bonus payout is weighted to players placing maximum wagers.

The gaming machine 22 shown in FIG. 3 also includes a player interface having a set of buttons 32 for the game presented on the display 26. The buttons 32 function as input mechanisms and may include mechanical buttons, electromechanical buttons, or touch screen buttons. While FIG. 3 illustrates a gaming machine having both touch screen buttons and mechanical buttons, other contemplated embodiments have only mechanical buttons or touch screen buttons. According to one embodiment, the buttons 32 are backlit to indicate whether the button is active. In another embodiment, one input mechanism is a universal button module that provides a dynamic button system adaptable for use with various games, as disclosed in U.S. application Ser. No. 11/106,212, entitled "Universal Button Module", filed Apr. 14, 2005 and U.S. application Ser. No. 11/223,364, entitled "Universal Button Module", filed Sep. 9, 2005, which are both hereby incorporated herein by reference. Additionally, other input devices, such as, but not limited to, a touch pad, track ball, mouse, switches, toggle switches, are included with the gaming machine to also accept player input. Optionally, one or more handles 34 may be "pulled" by a player to initiate a slots-based game.

In yet another embodiment, a cellular phone or other input device (e.g., PDA), separate and apart, from the gaming machine 12 may also be used to input various player choices and information to enhance the player's interactive experience with the gaming machine. In this embodiment, the gaming machine 12 also includes an IR sensor, RF sensor, BLUETOOTH receiver, or other means for receiving input from a cellular phone or other wireless input devices. Furthermore, inputting information via these devices provides an added level of security as any key presses may be hidden from view. In yet another embodiment, a player may call or send a text message or a short message service (SMS) to the gaming machine.

As shown in FIG. 3, the gaming machine 12 includes a ticket reader/ticket printer slot 36 that is associated with a cashless gaming system (not shown). According to one embodiment, the slot 36 is used for the ticket reader and ticket printer. Accordingly, the same slot 36 may be used to insert and/or issue a ticket. However, in alternate embodiments, separate slots (not shown) may be provided for the ticket acceptor and the ticket printer. In one embodiment, the ticket reader (not shown) of the cashless gaming system is capable of accepting previously printed vouchers, paper currency, promotional coupons, or the like. The ticket printer (not shown) of the cashless gaming system generates vouchers having printed information that includes, but is not limited to, the value of the voucher (i.e., cash-out amount) and a barcode that identifies the voucher. In another embodiment, the gaming machine may allow a player insert credit onto the gaming machine through an electronic funds transfer from a player's account. In this embodiment the slot may be a card reader for reading a credit or debit card from the player.

Additionally, each gaming machine 12 is in communication with a player tracking system (not shown). The player tracking system allows a casino to monitor the gaming activities of various players. The player tracking system typically includes a database of all qualified players (i.e., those players who have enrolled in a player rating or point accruing program). Generally, the database for the player tracking system is separate from the gaming machines. Additionally, the player tracking system is able to store data relating to a player's gaming habits as well as the player's preferences for gaming machine configuration. That is, a player can accrue player points that depend upon the amount and frequency of their wagers. Casinos can use these player points to compensate the loyal patronage of players. For example, casinos may award or "comp" a player free meals, room accommodations, tickets to shows, and invitations to casino events and promotional affairs.

The player tracking system is operatively connected to one or more input components on the gaming machine 12. These input components include, but are not limited to, a player card slots 38 for receiving a player tracking card, a keypad or equivalent, and a display 40. Accordingly, the gaming activity of the players may be tracked. Alternatively, the gaming machine includes no slot at all. If the gaming machine does not include a player card slot, the players may input player identification via a touch screen, keypad, or other input mechanisms that are associated with the player tracking system in lieu of inserting a player tracking card.

In another embodiment, each gaming machine 12 includes an Internet connection or other known network connections to link the plurality of gaming machines together. According to one embodiment, the Internet connection is used for web browsing, prize redemption, or access to other gaming or non-gaming information. With the various gaming machines in communication with one another (or a system host), the gaming machines 12 may participate in the group bonus feature. In one embodiment, the bonus is randomly paid out to a single gaming machine, and alternatively, the bonus is paid out to all or all eligible gaming machines. It has been contemplated that to be eligible, a player must be betting the maximum amount or have played a certain amount of money over a period of time, played for a certain amount of time, or any other determining feature.

The main cabinet 24 of the gaming machine 12 also houses a CPU, circuitry, and software for receiving signals from the player-activated buttons 28 and one or more handles 34, operating the games, and transmitting signals to the game display and speakers. In one embodiment, the game 22 and the bonus feature are operated by separate processors that are in communication with one another. In yet another embodiment, the game 22 and the bonus feature are operated remotely via one or more servers.

In various embodiments, one or more game programs may be stored in a memory (not shown) comprising a read only memory (ROM), volatile or non-volatile random access memory (RAM), a hard drive or flash memory device or any of several alternative types of single or multiple memory devices or structures. Optionally, each gaming machine 12 includes one or more data repositories for storing data. Examples of information stored by the gaming machines 12 include, but are not limited to, accounting data, maintenance history information, short and/or long-term play data, real-time play data, and sound data. In one embodiment, the data repository also stores display content configurations for various games and gaming machines.

In FIG. 3, the gaming machine 12 includes a top box 42 on the main cabinet 24. According to one embodiment, the top box is a separate and distinct component that is affixed to the main cabinet. In another embodiment, the top box is an area that is partitioned from the main cabinet. Alternatively, the top box and the main cabinet may be contiguous areas with the outward appearance of two distinct components. The top box may include a secondary display for displaying game information (e.g., name of the game, animation, one or more pay tables, game information, one or more help menus, progressive jackpot or game information, tournament game information, or any combination thereof) or non-game related information (e.g., news, advertisements, messages, promotions, or any combination thereof). In one embodiment, the secondary display presents a secondary game such as, but not limited to, a bonus game, progressive game, or a continuation game of the primary game. In yet another embodiment, the top box also includes a display glass that includes the name of the game, artwork, game instructions, pay table, or other information relating to one or more games presented on the gaming machine 12. In one embodiment, the secondary display may be used as the indicator 16 during the bonus feature, where the secondary display flashes or displays a symbol or color.

One of ordinary skill in the art will appreciate that not all gaming machines have all these components and may have other components in addition to, or in lieu of, those components mentioned here. Furthermore, while these components are viewed and described separately, various components may be integrated into a single unit in some embodiments.

Figure 4:
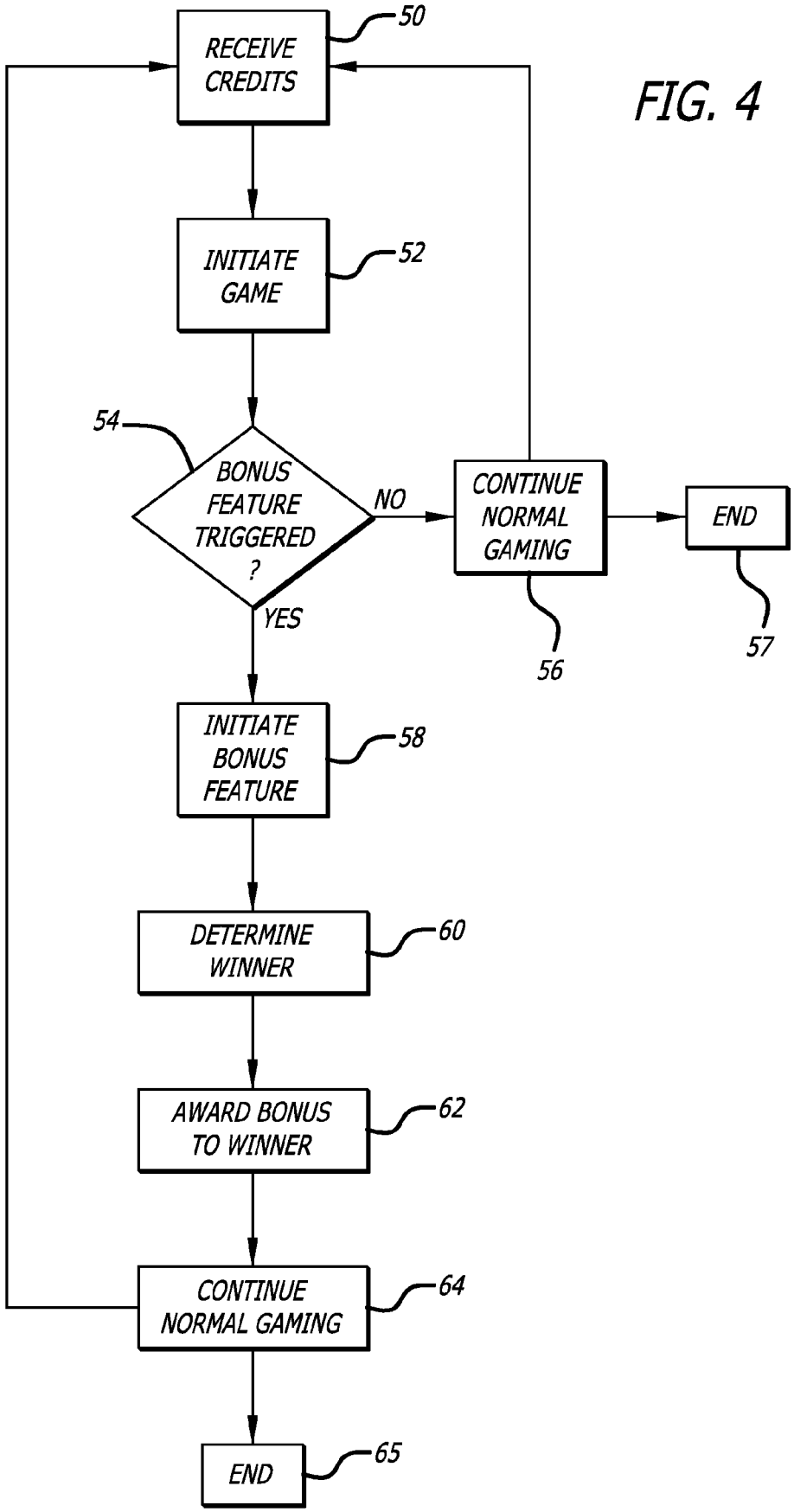
FIG. 4 depicts a flow diagram of one method of presenting a group play feature on associated gaming machines.

Referring now to FIG. 4, a flow diagram is shown representing one method of performing the group feature with the bonus feature module. At step 50, at least one of the plurality of gaming machines 12 receives credits from a player. The credits may be in the form of cash, cashless voucher, promotional credits, electronic fund transfers, or any other form of credit. One or more players may play the associated gaming machines 12. In some embodiments, a certain number of the eight machines need to be actively played or occupied by a player in order for the bonus feature to be initiated. In other embodiments, only one of the plurality of machines 12 needs to be played or occupied to activate the bonus feature.

At step 52, the active gaming machines 12 initiate the player-selected game. At step 54, while the gaming machines 12 are being played, the bonus feature module 21 monitors all of the gaming machines in the bank of associated gaming machines 10 and determines whether a triggering event has been established. In one embodiment, the triggering event may be any predetermined or random event, such as, but not limited to, exceeding an "$n^{th}$ coin in" threshold, a winning outcome, a randomly selected game outcome, a specialized bonus symbol, a predetermined number of maximum wagers, a predetermined number of paylines played, a player card level, time of play, frequency of play, or a combination thereof. The trigger may also be based upon a player's gaming activity, level within a club, based upon chance, or on a skill based outcome.

If the bonus feature module determines that no trigger event has occurred at any of the plurality of associated gaming machines 12, the game being played on each gamine machine continues as normal as indicated by step 56, and the game play ends as indicated by step 57 or continues by playing more credits at step 50. Alternatively, if a trigger event is detected, the bonus feature module 21 initiates a bonus feature on all associated gaming machines 12 in the bank of gaming machines 10 at step 58. In one embodiment, the initiation of the bonus feature may include an announcement being made at the circular bank of gaming machines 10, either visibly, tactilely, audibly, or any combination thereof. An audible message may play through speakers associated with the individual gaming machines 12 or the central display unit 14. Separately or in conjunction with the audible message, a display may be shown on the display 26 or secondary display of each gaming machine 12, either on the entire display or in a separate box displayed in front of the main game. It will be appreciated that any display associated with each particular gaming machine 12, may be used. Also, it has been contemplated that the visible announcement could be a message displayed on the central display unit 14, or could be the illumination or flashing of lights associated with the central display unit, the individual gaming machines 12, or chairs 20. The visible, tactile, and/or audible announcement of the bonus feature creates excitement for the players, which, in turn increases the player's interest in playing the gaming machines associated with the group bonus feature.

In one embodiment, after the announcement of the bonus feature, all of the lights go dim momentarily right before the bonus feature begins. Then, the indicators or lights 16 associated with the gaming machines 12 illuminate and exciting music may play through speakers associated with the gaming machine. The current gaming machine in the cycle has its lights go dim, and the lights associated with the adjacent slot machine moving in a sequential direction are then illuminated. Following this pattern, the currently activated lights go dim and the next adjacent slot machine in the sequence illuminate, and so on and so forth. The lights associated with each gaming machine are illuminated sequentially, and continue around and around the circular bank in a faster, increasingly exciting fashion. Increasing the frequency of illuminating the lights enhances excitement for the players during the bonus feature. In another embodiment, the frequency of illuminating the lights sequentially decreases or remains the same. This embodiment holds the suspense for the player. Also, each player's location during the bonus feature can include other means to enhance excitement. For example, the chairs 20 can vibrate as the gaming machines' lights illuminate. This can be accomplished by disposing a vibration device in the seat and/or back of the chair. Other tactile features can be associated with the chair or gaming machine to increase the excitement of the players. E.g., the seats can heat or cool as the potential to win the bonus increases or decreases.

Eventually, the sequential illumination of the lights ceases and only the lights associated with a single gaming machine remain illuminated indicating a winner at step 60. At step 62, the winning player is awarded a bonus, which can be a monetary award, or any item of value, or a prize. Then regular game play for the circular bank of gaming machines 10 resumes as indicated at step 64, where the game play ends at step 65 or continues by playing more credits at step 50.

In other embodiments, when the bonus feature is initiated, the sequential illumination of the lights 16 associated with the gaming machine could illuminate in any set or random order. In other embodiments, more than one gaming machine's lights can illuminate at once. Also, in an embodiment that does not include a circular bank of gaming machines, the lights are illuminated in any order from one machine to the next until a winner is determined.

This concept can also be used with tournaments, progressives, and system based gaming to award prizes to a player. For example, the system may allow a winner of a system based game prize, and then the gaming machine lights flash in sequential order and stop on the winning gaming machine.

It has been contemplated that the bonus feature module can randomly determine the winner of the bonus feature play before, during, or at the conclusion of the bonus feature play. In one embodiment, the bonus payout is weighted to max bet players. It will be appreciated that weighting may be applied to any criteria or combination thereof.

In one embodiment, the bonus feature module or the network server may monitor the number of gaming machines 12 that are actively being played in the bank of gaming machines 10 participating in the bonus feature. It may be a requirement for initiating the bonus feature that all of the associated gaming machines are occupied, or any number of gaming machines may be required by a bonus feature administrator. The bonus feature module may communicate with the network server to monitor which gaming machines are activated by a player tracking member. In another embodiment, the bonus feature module may also be in communication with the processors of each individual gaming machine to monitor whether the gaming machine is currently being played, or whether credits are currently available on the gaming machine.

In another embodiment, sensors can be used with the system, and the sensors can be in communication with the bonus feature module to monitor the presence of a player sitting or standing at a gaming machine. Pressure sensors in the seats can be used to determine if a player is sitting at a gaming machine. Motion, heat sensors, biometric sensors (including finger and eye scanners), radio-frequency identification ("RFID") technology, and any other technology can also be used to detect the presence of a player at a gaming machine. In this way, only occupied gaming machines may be used during the bonus feature.

The bonus feature module may be programmed so that only an active gaming machine (player currently playing machine) can be chosen as the bonus feature winner. Still, in another embodiment, any of the associated gaming machines may be chosen as the winning machine regardless of whether a player is currently playing the machine. If a player-less gaming machine happens to win the bonus, the award may or may not be paid out depending on the desires of the bonus feature administrator. If the bonus is paid out to a player-less gaming machine, the first player to reach the winning gaming machine can claim the bonus. In other embodiments, the bonus feature module is programmed so that only gaming machines currently occupied (player sitting at machine whether or not they are playing on the machine) by a player can be chosen as the bonus feature winner.

Figure 5:
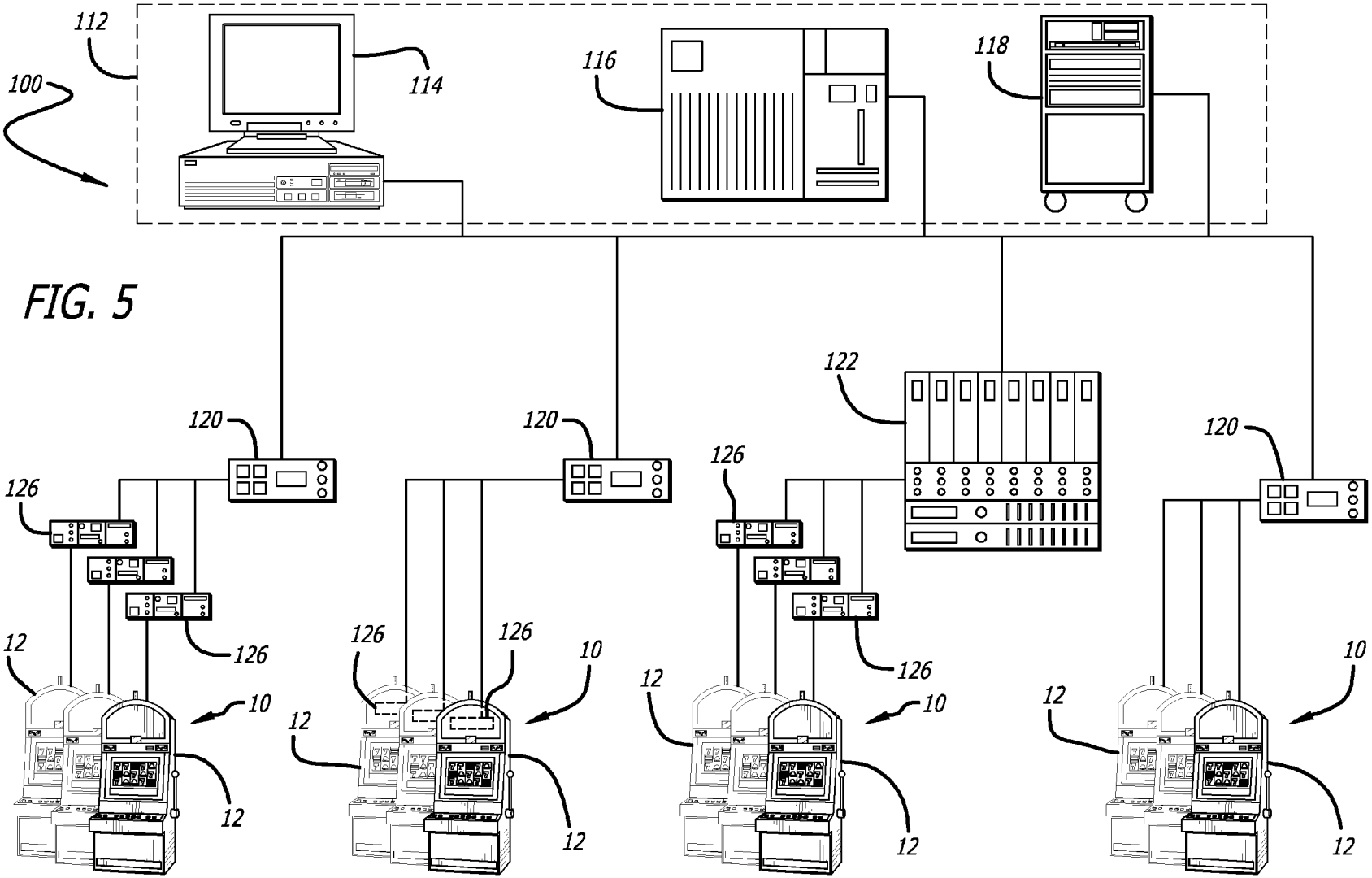
FIG. 5 depicts a diagram of one embodiment of a gaming system including a plurality of gaming machines presenting a group play feature.

Referring now to FIG. 5, a casino gaming system 100 is illustrated. The casino gaming system 100 comprises one or more gaming machines 12 and may include one or more banks of associated gaming devices 10. The gaming machines 12 illustrated in FIG. 3 act as terminals for interacting with a player playing a casino game. Networking components facilitate communications between a system server 112 and game management units 126 that control displays for carousels of gaming machines 12 across a network. Game management units (GMU's) 126 connect gaming machines to networking components and may be installed in the gaming machine cabinet or external to the gaming machine 12. The function of the GMU 126 is similar to the function of a network interface card connected to a desktop personal computer (PC). Some GMU's 126 have much greater capability and can perform such tasks as presenting and playing a game using a display (not shown) operatively connected to the GMU 126. In one embodiment, the GMU 126 is a separate component located outside the gaming machine 12. Alternatively, in another embodiment, the GMU 126 is located within the gaming machine 12. Optionally, in an alternative embodiment, one or more gaming machines 12 connect directly to a network and are not connected to a GMU 126. In certain embodiments, the GMU 126 may have the capacity to act as the bonus feature module.

The gaming machines 12 are connected via a network to a network bridge 120, which is used for networking, routing and polling gaming machines, including slot machines. The network bridge 120 connects to a back end system 112. Optionally, the gaming machines 12 may connect to the network via a network rack 122, which provides for a few number of connections to the back end system 112. Both network bridge 120 and network rack 122 may be classified as middleware, and facilitate communications between the back end system 112 and the game management units 126. The network bridges 120 and network rack 122 may comprise data repositories for storing network performance data. Such performance data may be based on network traffic and other network related information. Optionally, the network bridge 120 and the network rack 122 may be interchangeable components. For example, in one embodiment, a casino gaming system may comprise only network bridges and no network racks. Alternatively, in another embodiment, a casino gaming system may comprise only network racks and no network bridges. Additionally, in an alternative embodiment, a casino gaming system may comprise any combination of one or more network bridges and one or more network racks.

The back end system 112 may be configured to comprise one or more servers, and as previously stated, the back end system can house the bonus feature module. The type of server employed is generally determined by the platform and software requirements of the gaming system. In one embodiment, as illustrated in FIG. 5, the back end system 112 is configured to include three servers: a slot floor controller 114, a casino management server 116 and a casino database 118. The slot floor controller 114 is a part of the player tracking system for gathering accounting, security and player specific information. The casino management server 116 and casino database 118 work together to store and process information specific to both employees and players. Player specific information includes, but is not limited to, passwords, biometric identification, RFID, player card identification, and biographic data. Additionally, employee specification information may include biographic data, biometric information, job level and rank, passwords, authorization codes and security clearance levels.

Overall, the back end system 112 performs several functions. For example, the back end system 112 can collect data from the slot floor as communicated to it from other network components, and maintain the collected data in its database. The back end system 112 may use slot floor data to generate a report used in casino operation functions. Examples of such reports include, but are not limited to, accounting reports, security reports, and usage reports. The back end system 112 may also pass data to another server for other functions. Alternatively, the back end system 112 may pass data stored on its database to floor hardware for interaction with a game or game player. For example, data such as a game player's name or the amount of a ticket being redeemed at a game may be passed to the floor hardware. Additionally, the back end system 112 may comprise one or more data repositories for storing data. Examples of types of data stored in the system server data repositories include, but are not limited to, information relating to individual player play data, individual game accounting data, gaming machine accounting data, cashable ticket data, sound data, and optimal display configurations for one or more displays for one or more system game.

Of course, one will appreciate that the gaming system 100 may also comprise other types of components, and the above illustrations are meant only as examples and not as limitations to the types of components or games used in a casino gaming system presenting a group play feature.

One of ordinary skill in the art will appreciate that not all group bonus feature systems have all these components and may have other components in addition to, or in lieu of, those components mentioned here. Furthermore, while these components are viewed and described separately, various components may be integrated into a single unit in some embodiments.

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A method for presenting a game having a bonus feature, the method comprising:

initiating the game on at least one of a plurality of gaming machines associated with one another and arranged in a circular bank;

determining whether a triggering event has occurred on any of the plurality of gaming machines;

determining which of the plurality of gaming machines are being activated by players;

initiating the bonus feature on the plurality of gaming machines in response to the triggering event, wherein at least one of the plurality of gaming machines is not being activated by one of the players;

activating indicators associated with each gaming machine, including the at least one gaming machine that is not being activated by one of the players, in a sequential order around the circular bank for an amount of time;

stopping the progression of activating the indicators in the sequential order so that only one gaming machine's indicator remains activated to designate a winning gaming machine of the bonus feature; and awarding a bonus to the winning gaming machine, wherein the at least one gaming machine that is not being activated by one of the players is eligible to be the winning gaming machine, wherein the bonus is claimed by any of the players to reach the winning gaming machine first when the at least one gaming machine that is not being activated by one of the players is the winning gaming machine.

2. The method of claim 1, wherein the trigger event is a winning outcome, a randomly selected game outcome, a specialized bonus symbol, a predetermined number of maximum wagers, a predetermined number of paylines played, a player card level, time of play, frequency of play, or a combination thereof.

3. The method of claim 1, further comprising announcing the start of the bonus feature in response to the triggering event.

4. The method of claim 1, wherein there are eight gaming machines associated with one another and arranged in the circular bank.

5. The method of claim 1, further comprising disposing a central display unit on top of the plurality of gaming machines in the circular bank, wherein the activating indicators are located on the central display unit.

6. The method of claim 1, wherein increasing the frequency of activating the indicators associated with each of the plurality of gaming machines in the sequential order around the circular bank.

7. The method of claim 1, further comprising weighting the bonus payout to max bet players.

8. A method for presenting a game, the method comprising:

initiating the game on at least one of a plurality of gaming machines positioned for association with one another;

determining which of the plurality of gaming machines associated with one another are being activated by players;

determining whether a triggering event has occurred on any of the plurality of gaming machines;

initiating a bonus feature on the plurality of gaming machines in response to the triggering event, wherein at least one of the plurality of gaming machines is not being activated by one of the players;

activating indicators associated with each gaming machine, including the at least one gaming machine that is not being activated by one of the players, in a sequential order;

stopping the progression along the sequential order of activating the indicators so that only one gaming machine's indicator remains activated to designate a winning gaming machine of the bonus feature; and awarding a bonus to the winning gaming machine, wherein the at least one gaming machine that is not being activated by one of the players is eligible to be the winning gaming machine, wherein the bonus is claimed by any of the players to reach the winning gaming machine first when the at least one gaming machine that is not being activated by one of the players is the winning gaming machine.

9. The method of claim 8, wherein the trigger event is a winning outcome, a randomly selected game outcome, a specialized bonus symbol, a predetermined number of maximum wagers, a predetermined number of paylines played, a player card level, time of play, frequency of play, or a combination thereof.

10. The method of claim 8, further comprising announcing the start of the bonus feature in response to the triggering event.

11. The method of claim 8, further comprising determining which of the plurality of gaming machines are being occupied.

12. The method of claim 8, further comprising disposing a central display unit on top of the plurality of gaming machines associated with one another, wherein the indicators are located on the central display unit.

13. The method of claim 8, wherein increasing the frequency of activating the indicators associated with each of the plurality of gaming machines in a sequential order.

14. A method for presenting a game, the method comprising:

initiating the game on a plurality of gaming machines associated with one another in a circular bank;

determining which of the plurality of gaming machines are occupied by players, and whether a prerequisite number of gaming machines associated with one another in the circular bank are occupied by players;

determining whether a triggering event has occurred on any of the plurality of gaming machines;

initiating a bonus feature on the plurality of gaming machines in response to the triggering event, wherein at least one of the plurality of gaming machines is not occupied by one of the players;

activating indicators associated with each gaming machine, including the at least one gaming machine that is not occupied by one of the players, in a sequential order;

stopping the progression along the sequential order of activating the indicators so that only one gaming machine indicator remains activated, wherein the last gaming machine indicator to be activated designates a winning gaming machine of the bonus feature; and awarding a bonus to the winning gaming machine, wherein the at least one gaming machine that is not occupied by one of the players is eligible to be the winning gaming machine, wherein the bonus is claimed by any of the players to reach the winning gaming machine first when the at least one gaming machine that is not occupied by one of the players is the winning gaming machine.

15. The method of claim 14, wherein determining which gaming machines are occupied includes using a sensor to detect the presence of the players at the plurality of gaming machines.

16. The method of claim 14, further comprising announcing the initiation of the bonus feature.

17. A method for presenting a game having a bonus feature, the method comprising:

initiating the game on at least one of a plurality of gaming machines associated with one another during the bonus feature;

determining whether a triggering event has occurred on any of the plurality of gaming machines;

determining which of the plurality of gaming machines are being activated by players;

initiating the bonus feature on the plurality of gaming machines in response to the triggering event, wherein at least one of the plurality of gaming machines is a player-less gaming machine;

activating indicators associated with each gaming machine, including the at least one player-less gaming machine, for an amount of time;

stopping the activation of the indicators so that only one gaming machine's indicator remains activated to designate a winning gaming machine of the bonus feature; and awarding a bonus to the winning gaming machine, wherein the at least one player-less gaming machine is eligible to be the winning gaming machine, wherein the bonus is claimed by any of the players to reach the winning gaming machine first when the at least one player-less gaming machine is the winning gaming machine.

18. The method of claim 17, further comprising activating the indicators associated with each gaming machine in a sequential order.

19. The method of claim 17, further comprising activating the indicators associated with each gaming machine in a non-sequential order.

20. The method of claim 17, wherein the indicators associated with each gaming machine are visual.

21. The method of claim 17, wherein the indicators associated with each gaming machine are audible.

22. The method of claim 17, wherein the indicators associated with each gaming machine are tactile.

* * * * *

UNITED STATES PATENT AND TRADEMARK OFFICE

CERTIFICATE OF CORRECTION

PATENT NO. : 8,235,784 B2
APPLICATION NO. : 12/108468
DATED : August 7, 2012
INVENTOR(S) : Erik Christensen It is certified that error appears in the above-identified patent and that said Letters Patent is hereby corrected as shown below:

In the Specifications:

Column 2, In line 8 remove “s” from “locations”

Column 2, In line 46 add --S-- to “DRAWING”

Column 3, In line 42 add --h-- to “eight”

Column 5, In line 19 insert --or-- after “switches,” and before “toggle”

Signed and Sealed this
Twenty-eighth Day of May, 2013

Teresa Stanek Rea
*Acting Director of the United States Patent and Trademark Office*